US008439024B2

(12) United States Patent
Barnett

(10) Patent No.: US 8,439,024 B2
(45) Date of Patent: May 14, 2013

(54) MULTI-PURPOSE CROSSBOW COCKING DEVICE AND METHOD

(75) Inventor: David A. Barnett, Tarpon Springs, FL (US)

(73) Assignee: Barnett Outdoors, LLC, Tarpon Springs, FL (US)

( * ) Notice: Subject to any disclaimer, the term of this patent is extended or adjusted under 35 U.S.C. 154(b) by 323 days.

(21) Appl. No.: 12/855,547

(22) Filed: Aug. 12, 2010

(65) Prior Publication Data

US 2012/0037139 A1 Feb. 16, 2012

(51) Int. Cl.
*F41B 5/12* (2006.01)

(52) U.S. Cl.
USPC ..... 124/25

(58) Field of Classification Search ..... 124/23.1, 124/25, 86, 88
See application file for complete search history.

(56) References Cited

U.S. PATENT DOCUMENTS 4,603,676 A 8/1986 Luoma
4,719,987 A 1/1988 Gaudreau
5,115,795 A 5/1992 Farris
5,220,906 A 6/1993 Choma
5,243,956 A 9/1993 Luehring
5,823,172 A 10/1998 Suggitt
6,095,128 A 8/2000 Bednar
6,286,496 B1 9/2001 Bednar
6,705,304 B1 3/2004 Pauluhn
6,874,491 B2 4/2005 Bednar
6,913,007 B2 7/2005 Bednar
7,017,568 B1 3/2006 Smith
7,318,429 B2 * 1/2008 Achkar ..... 124/86
7,624,725 B1 12/2009 Choma

OTHER PUBLICATIONS (Co-pending application) Design U.S. Appl. No. 29/367,764, "Crossbow Cocking Handle," David A. Barnett, filed Aug. 12, 2010.

* cited by examiner

*Primary Examiner* — John Ricci
(74) *Attorney, Agent, or Firm* — Jones Walker LLP

(57) ABSTRACT

A multi-purpose crossbow cocking device having two handles attached by a draw cord or string. Slidably affixed to the cord are a pair of pulley members having hooks that engage a bow string of a crossbow. The handles may have an inner cavity. One or both of the handles may contain one or more Allen wrenches pivotally connected to the handle within the inner cavity. In its retracted position, the Allen wrench is housed within the inner cavity. In its extended position, the distal end of the Allen wrench is placed external of the handle's inner cavity and may be used to drive a bolt or screw with a hexagonal shaft head. The Allen wrenches may be different sizes.

18 Claims, 4 Drawing Sheets

MULTI-PURPOSE CROSSBOW COCKING DEVICE AND METHOD

FIELD OF THE INVENTION

The present invention relates to a multi-purpose crossbow cocking device and method, and more particularly to a multi-purpose draw-string crossbow cocking device having handles that include one or more Allen wrenches and method of using the device.

BACKGROUND OF THE INVENTION

Cocking a crossbow involves drawing the bow string back in the direction of the stock's rearward end until the bow string is positioned within the trigger mechanism. The trigger mechanism holds the bow string in its drawn position until the trigger is actuated to release the bow string. Because of the tension applied to the bow string by the bow limbs, it is often difficult, even for persons with above-average strength, to overcome the tension force applied by the bow limbs necessary to pull or draw the bow string back along the barrel of the crossbow and into cocking position within the trigger mechanism. Cocking devices have therefore been developed to make it easier for persons to cock a crossbow.

U.S. Pat. No. 5,243,956, incorporated by reference herein, describes one such cocking device comprising a draw string or cord with two handles and a pair of pulleys. The middle of the string is placed over the end of the crossbow's stock and the pulleys hooked to the bow string. Gripping the handles, a user pulls upward in the direction of the stock's rearward end causing the bow string to be drawn in the cocking position. The leverage provided by the draw string and its placement on the end of the stock make the process of drawing the bow string into cocking position much easier. The cocking device reduces the pulling force needed to cock the crossbow by about one-half.

Crossbows have component parts that require addition, adjustment, or replacement. Many of these components are affixed to the crossbow by bolts or screws that have a hexagonal socket head (internal-wrenching hexagonal drive). A hex key, also known as an Allen key or wrench, is a tool with a hexagonal cross-section used to drive the aforesaid bolts or screws. Because the cross-section or size of the hexagonal socket for a particular bolt or screw may differ, Allen wrenches come in different sizes to accommodate the different sized socket heads of the bolts or screws. Persons desiring to add, adjust or replace crossbow components will need a set of different sized Allen wrenches.

Crossbows are used for hunting and target practice. As such, the user will transport his or her crossbow to areas, often remote, where such hunting or target practice activities take place. To add, adjust or replace crossbow components at such remote locations means that the user will need to travel with a set of Allen wrenches. Packing a set of Allen wrenches is undesired because it complicates the user's packing needs and adds some additional weight, which may be a concern if the user is, for example, backpacking. It also requires the user to remember to bring the set of Allen wrenches on his or her journey to the hunting or practice location. Given the fallibility of the human condition, users often find themselves in need of their Allen wrenches at such remote locations only to discover that they have forgotten to pack them. This can result in the user being unable to participate in the desired hunting or target practice activity because the crossbow will not function properly. The present invention has been developed to alleviate these problems.

SUMMARY OF THE INVENTION

It is an object of the present invention to combine a set of Allen wrenches and a crossbow cocking device.

These and other objects and advantages are achieved by the novel multi-purpose crossbow cocking device and method of the present invention. In one embodiment of the present invention the multi-purpose crossbow cocking device includes a draw cord having a first end and a second end. A first handle is attached to the first end of the cord. The first handle includes a first Allen wrench. A second handle is attached to the second end of the cord. The embodiment also includes a pair of pulley members. Each pulley member has a hook, a pulley groove, and an opening for slidably retaining the cord. The hook is capable of selectively engaging a bow string of a crossbow when the device is placed in a cocking position on the crossbow.

The first Allen wrench may be retractable. The second handle may also include a first Allen wrench. Each of the first Allen wrenches may be retractable.

The first Allen wrenches may be sized different from each other. The size of each of the first Allen wrenches may be selected from the group consisting of 3/16 inches, 3/32 inches, 5/32 inches, and 3 millimeters.

The first handle may include a second Allen wrench sized different from the first Allen wrench of the first handle. The size of the first Allen wrench of the first handle may be 3/16 inches and the size of the second Allen wrench of the first handle may be 3/32 inches.

The second handle may have a first Allen wrench and a second Allen wrench sized different from each other. The size of the first Allen wrench of the second handle may be 5/32 inches and the size of the second Allen wrench of the second handle may be 3 millimeters.

The first and second handles may each be formed in part of a compressible material. The first and second handles may also each include an elevated area for gripping the handle.

In another embodiment of the present invention the multi-purpose crossbow cocking device has a draw cord having a first end and a second end. A first handle is attached to the first end of the cord. The first handle includes a first retractable Allen wrench and a second retractable Allen wrench. A second handle is attached to the second end of the cord. The second handle includes a first retractable Allen wrench and a second retractable Allen wrench. The device also includes a pair of pulley members. Each pulley member has a hook, a pulley groove, and an opening for slidably retaining the cord. The hook is capable of selectively engaging a bow string of a crossbow when the device is placed in a cocking position on the crossbow.

The first and second handles may each have an inner cavity. The first and second retractable Allen wrenches of the first handle may be disposed within the inner cavity of the first handle when in a retracted position. The first and second retractable Allen wrenches of the second handle may be disposed within the inner cavity of the second handle when in a retracted position.

The first and second retractable Allen wrenches of the first handle may each have a curved proximal end and a straight distal end. The curved proximal end may be pivotally affixed to the first handle within the inner cavity.

The first and second retractable Allen wrenches of the second handle may each have a curved proximal end and a straight distal end. The curved proximal end pivotally may be affixed to the second handle within the inner cavity.

The present invention is also directed to a method of using the multi-purpose crossbow cocking device of the present invention. The method includes the step of providing a multi-purpose crossbow cocking device comprising: a draw cord having a first end and a second end; a first handle attached to the first end of the cord, the first handle including an Allen wrench; a second handle attached to the second end of the cord; a pair of pulley members, each pulley member having a hook, a pulley groove, and an opening for slidably retaining the cord, the hook capable of selectively engaging a bow string of a crossbow when the device is placed in a cocking position on the crossbow. The method also includes the step of manipulating the Allen wrench to drive a bolt or screw operatively associated with the crossbow. The bolt or screw having a hexagonal shaft head.

The method may also include the step of placing a middle section of the cord in a cocking groove positioned on a stock of the crossbow. The method may include the step of attaching the hooks of the pair of pulley members to the bow string. The method may include the step of pulling the first and second handles in an upward direction towards the rearward end of the stock until the bow string is retained by the trigger mechanism of the crossbow. The method may also include the step of removing the hooks of the pair of pulley means from the bow string.

DETAILED DESCRIPTION OF THE PREFERRED EMBODIMENTS

Figure 1:
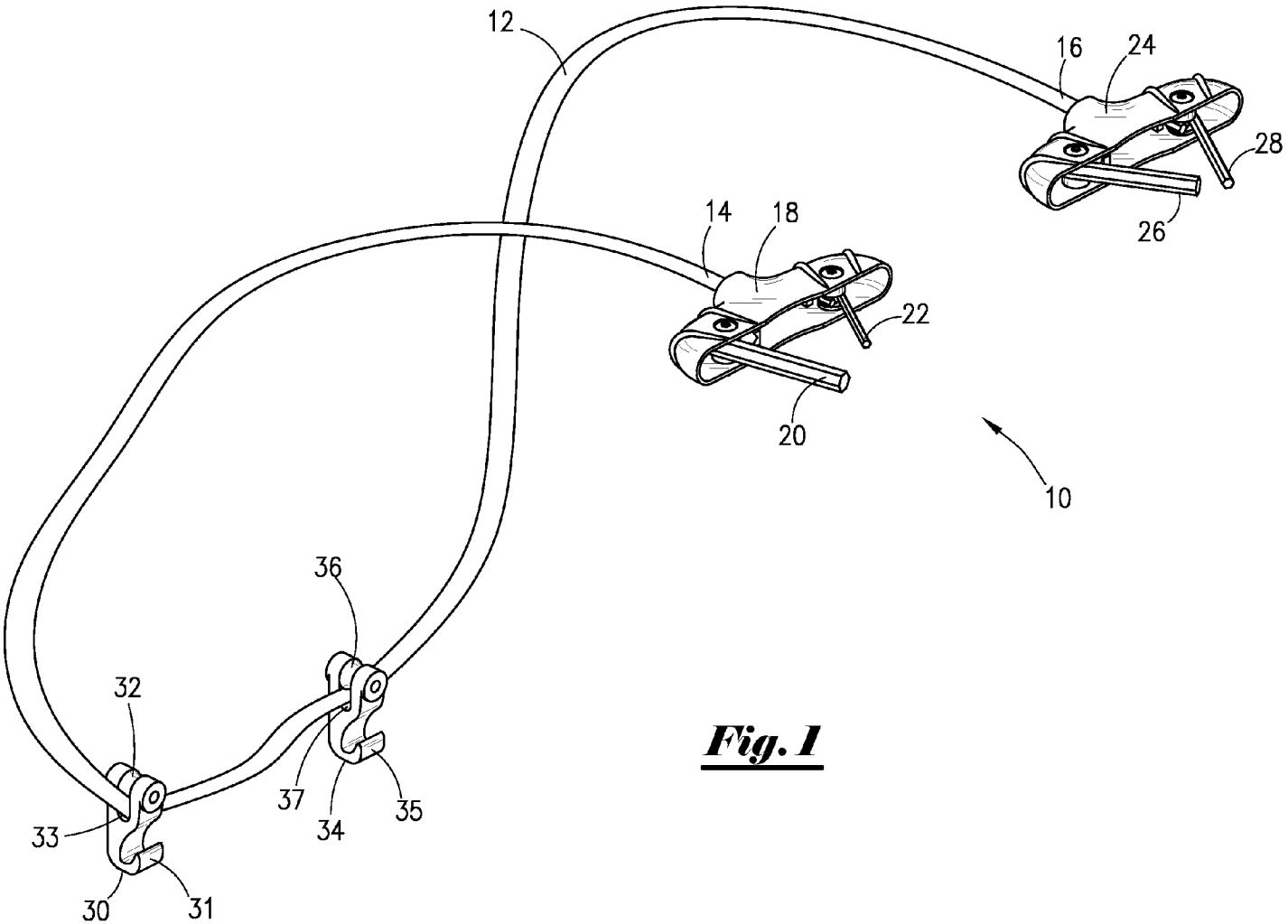
FIG. 1 is an isometric view of the multi-purpose crossbow cocking device of the present invention.

With reference to FIG. 1, crossbow cocking device 10 includes draw string or cord 12 having first end 14 and second end 16. First handle 18 may be attached to first end 14 of cord 12. First handle 18 may include first retractable wrench 20 and second retractable wrench 22. Second handle 24 may be attached to second end 16 of cord 12. Second handle 24 may include first retractable wrench 26 and second retractable wrench 28.

First and second handles 18, 24 may be designed for gripping by a user. A portion of each of handles 18, 24 may include a soft, compressible material for increased comfort of a user's hand.

Wrenches 20, 22, 26, and 28 may be Allen wrenches of the same or different sizes. In a preferred embodiment, wrench 20 is a 3/16 inch Allen wrench, wrench 22 is a 3/32 inch Allen wrench, wrench 26 is a 5/32 inch Allen wrench, and wrench 28 is a 3 millimeter Allen wrench.

Device 10 may also include first pulley member 30 having first hook 31, first groove 32, and first opening 33. Device 10 may further include second pulley member 34 having second hook 35, second groove 36, and second opening 37. Cord 12 may be slidingly disposed through first opening 33 of first pulley member 30 and second opening 37 of second pulley member 34. In one embodiment, first and second grooves 32, 36 may be formed of brass to assist cord 12 in traveling through first and second openings 33, 37.

Figure 2:
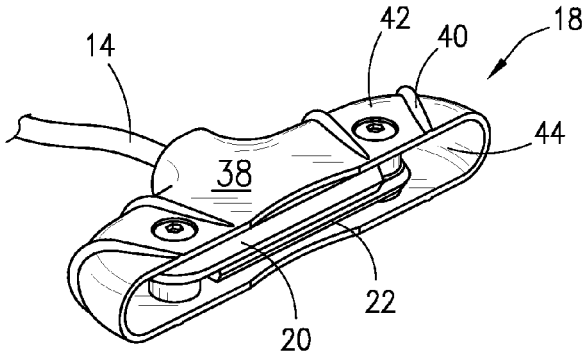
FIG. 2 is an isometric view of a handle of the multi-purpose crossbow cocking device of the present invention in retracted position.
Figure 3:
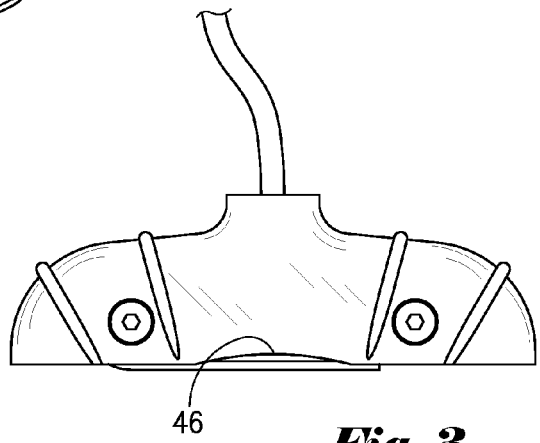
FIG. 3 is a front view of the handle shown in FIG. 2.

As illustrated in FIG. 2, handle 18 (or handle 24) may include grip member 38. One or more elevated sections 40 may be mounted on outer surface 42 of grip member 38 to form gripping ridges. Alternatively, outer surface 42 of grip member 38 may have integral gripping ridges formed thereon. In still another embodiment, grip member 38 may have no gripping ridges. In a retracted position, first retractable wrench 20 and second retractable wrench 22 may be folded into inner cavity 44 of grip member 38. As shown in FIG. 3, grip member 38 may include recess 46, which enables a user to grip first retractable wrench 20 or second retractable wrench 22 in order to move wrench 20 or 22 from the retracted position to an extended position (shown in FIG. 5).

Figure 4:
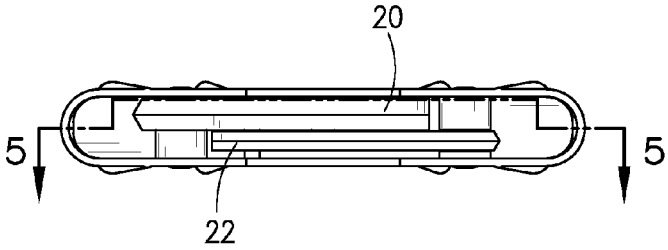
FIG. 4 is a top view of the handle shown in FIG. 2.
Figure 5:
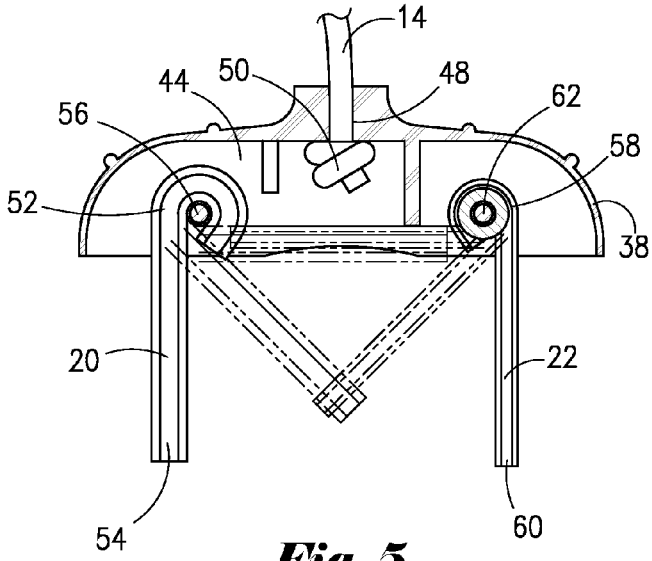
FIG. 5 is a cross-sectional view of the handle shown in FIG. 4 taken along line 5-5 showing different positions of the Allen wrenches.

Referring now to FIG. 4, first retractable wrench 20 may be disposed beside second retractable wrench 22 in the retracted position. Handle 18 may be secured to first end 14 of cord 12 by any securing means. For example, first end 14 of cord 12 may be disposed through central opening 48 of grip member 38 as shown in FIG. 5, and knot 50 in first end 14 may be disposed within said inner cavity 44 in order to secure handle 18 on first end 14. Alternatively, handle 18 may be secured to first end 14 by bracket, hook, or any other securing mechanism.

Referring again to FIG. 5, first retractable wrench 20 may have curved proximate end 52 and distal end 54. Curved proximate end 52 may be disposed around first pivot axis 56, and may rotate around first pivot axis 56 when wrench 20 is transferred between the retracted position and the extended position. In the retracted position, distal end 54 may be disposed within inner cavity 44. In the extended position, distal end 54 is disposed outside of inner cavity 44. Second retractable wrench 22 may have curved proximate end 58 and distal end 60. Curved proximate end 58 may be disposed around second pivot axis 62, and may rotate around second pivot axis 62 when wrench 22 is transferred between the retracted position and the extended position. In the retracted position, distal end 60 may be disposed within inner cavity 44. In the extended position, distal end 60 is disposed outside of inner cavity 44.

Figure 6:
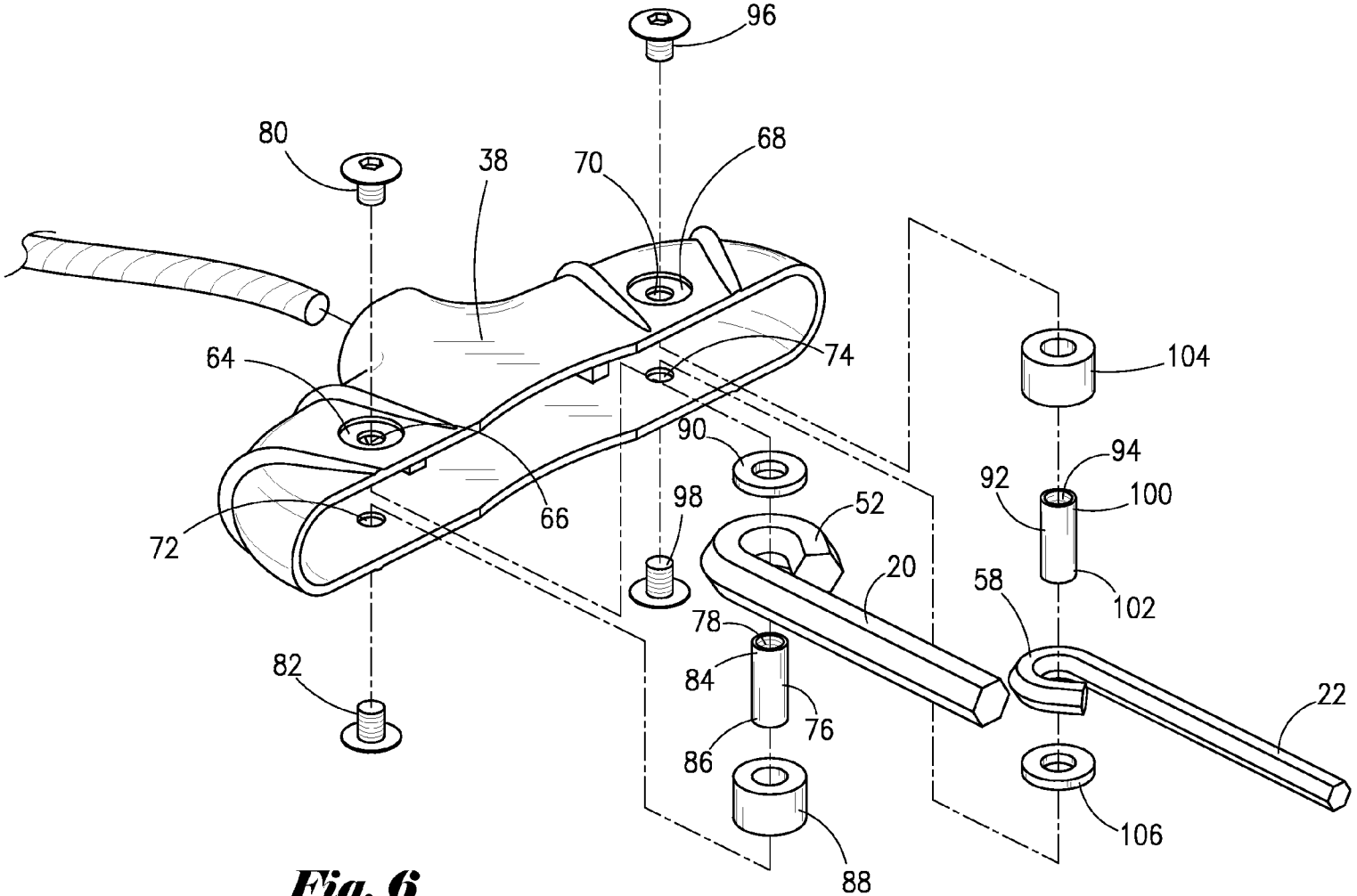
FIG. 6 is an exploded view of the handle of the multi-purpose crossbow cocking device of the present invention.

FIG. 6 is an exploded view illustration of handle 18 (or handle 24) in one embodiment. Grip member 38 may include first forward recess 64, first forward aperture 66, second forward recess 68, second forward aperture 70, first rearward recess (not shown), first rearward aperture 72, second rearward recess (not shown), and second rearward aperture 74. First sleeve 76 includes threaded inner surface 78 for engaging first forward screw 80 and first rearward screw 82. First sleeve 76 also includes forward end 84 and rearward end 86. First sleeve 76 may be disposed through curved proximate end 52 of wrench 20 for securing wrench 20 to grip member 38. First sleeve 76 provides first pivot axis 56 (shown in FIG. 5) around which curved proximate end 52 rotates. First spacer 88 may be disposed around rearward end 86 of first sleeve 76. First washer 90 may be disposed around forward end 84 of first sleeve 76. First spacer 88 and first washer 90 may position first retractable wrench 20 in a forward area of said inner cavity 44.

Referring still to FIG. 6, second sleeve 92 includes threaded inner surface 94 for engaging second forward screw 96 and second rearward screw 98. Second sleeve 92 also includes forward end 100 and rearward end 102. Second sleeve 92 may be disposed through curved proximate end 58 of wrench 22 for securing wrench 22 to grip member 38. Second sleeve 92 provides second pivot axis 62 (shown in FIG. 5) around which curved proximate end 58 rotates. Second spacer 104 may be disposed around forward end 100 of second sleeve 92. Second washer 106 may be disposed around rearward end 102 of second sleeve 92. Second spacer 104 and second washer 106 may position second retractable wrench 22 in a rearward area of said inner cavity 44. First forward recess 64 may prevent first forward screw 80 from protruding above the surface of grip member 38. In the same manner, each of first rearward recess (not shown), second forward recess 68, and second rearward recess (not shown) prevent each of first rearward screw 82, second forward screw 96, and second rearward screw 98, respectively, from protruding above the surface of grip member 38.

Figure 7:
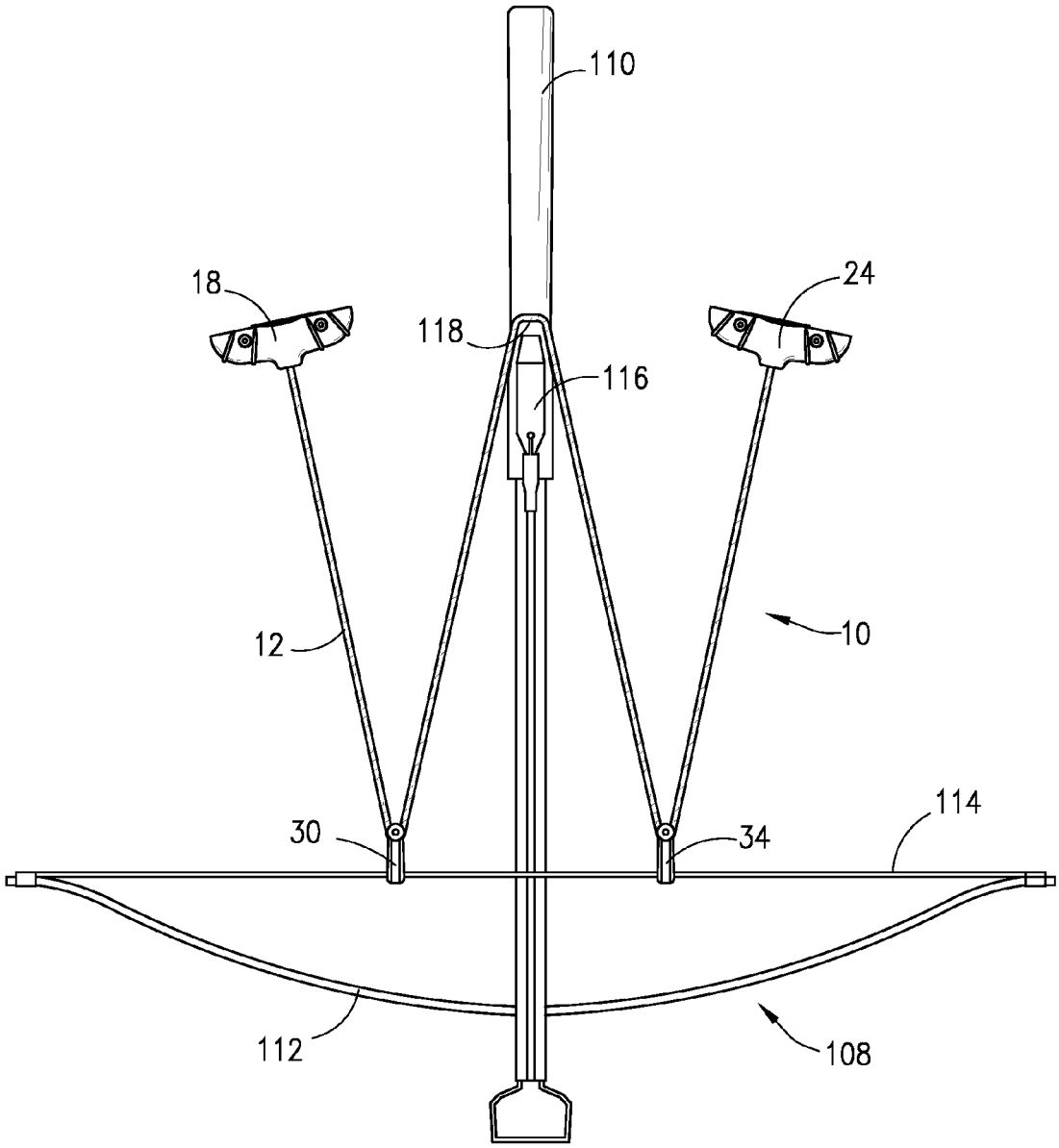
FIG. 7 is a schematic view of the multi-purpose crossbow cocking device of the present invention placed on an exemplar crossbow for cocking.

FIG. 7 illustrates device 10 with an exemplar crossbow 108, which may include stock 110, bow 112, bow string 114, and scope 116. Cord 12 may be positioned in cocking groove 118 on stock 110. First and second pulley members 30, 34 may be attached to bow string 114.

A user may first place the center of cord 12 in cocking groove 118 on stock 110. Then, the user may attach first pulley member 30 to bow string 114 on one side of stock 110 by placing bow string 114 in first hook 31. Second pulley member 34 may be attached to bow string 114 on the other side of stock 110 by placing bow string 114 in second hook 35. Holding handle 18 in one hand and handle 24 in the other hand, a user may then pull bow string 114 into a trigger mechanism on crossbow 108. When shot, bow string 114 will be released from the trigger mechanism.

Wrenches 20, 22, 26, or 28 may be rotated or pivoted out of handle 18 or handle 24 when it is desirable to use the wrenches. The hexagonal drive shaft end of wrench 20, 22, 26, or 28 may be inserted into the hexagonal shaft head of a bolt or screw and the wrench turned clockwise to drive the bolt or screw into its corresponding recess on crossbow 108 or any component thereof to affix a part or component to crossbow 108. If it is desired to remove a part or component from crossbow 108, wrench 20, 22, 26, or 28 is turned in a counterclockwise direction which will drive the bolt or screw out of the corresponding recess. Wrenches 20, 22, 26, or 28 may be used to add, adjust, or replace crossbow components or part. For example, wrench 20, 22, 26, or 28 may be used to adjust scope 116 or any other component of crossbow 108 that requires an Allen wrench.

While preferred embodiments of the present invention have been described, it is to be understood that the embodiments are illustrative only and that the scope of the invention is to be defined solely by the appended claims when accorded a full range of equivalents, many variations and modifications naturally occurring to those skilled in the art from a review hereof.

What is claimed is:

1. A multi-purpose crossbow cocking device comprising:

a draw cord having a first end and a second end;

a first handle attached to said first end of said cord, said first handle including a first Allen wrench operationally affixed to said first handle;

a second handle attached to said second end of said cord;

a pair of pulley members, each pulley member having a hook, a pulley groove, and an opening for slidably retaining said cord, said hook capable of selectively engaging a bow string of a crossbow when said device is placed in a cocking position on said crossbow.

2. The device according to claim 1, wherein said first Allen wrench is retractable.

3. The device according to claim 1, wherein said second handle includes a first Allen wrench operationally affixed to said second handle.

4. The device according to claim 3, wherein each of said first Allen wrenches is retractable.

5. The device according to claim 4, wherein said first Allen wrenches are sized different from each other.

6. The device according to claim 5, wherein said size of each of said first Allen wrenches is selected from the group consisting of 3/16 inches, 3/32 inches, 5/32 inches, and 3 millimeters.

7. The device according to claim 1, wherein said first handle includes a second Allen wrench sized different from said first Allen wrench of said first handle, wherein said second Allen wrench is operationally affixed to said first handle.

8. The device according to claim 7, wherein said size of said first Allen wrench of said first handle is 3/16 inches and said size of said second Allen wrench of said first handle is 3/32 inches.

9. The device according to claim 8, wherein said second handle has a first Allen wrench operationally affixed to said second handle and a second Allen wrench operationally affixed to said second handle, wherein said first Allen wrench and said second Allen wrench of said second handle are sized different from each other.

10. The device according to claim 9, wherein said size of said first Allen wrench of said second handle is 5/32 inches and said size of said second Allen wrench of said second handle is 3 millimeters.

11. The device according to claim 1, wherein said first and second handles are each formed in part of a compressible material.

12. The device according to claim 1, wherein said first and second handles each includes an elevated area for gripping said handle.

13. A multi-purpose crossbow cocking device, comprising:

a draw cord having a first end and a second end;

a first handle attached to said first end of said cord, said first handle including a first retractable Allen wrench operationally affixed to said first handle and a second retractable Allen wrench operationally affixed to said first handle;

a second handle attached to said second end of said cord, said second handle including a first retractable Allen wrench operationally affixed to said second handle and a second retractable Allen wrench operationally affixed to said second handle;

a pair of pulley members, each pulley member having a hook, a pulley groove, and an opening for slidably retaining said cord, said hook capable of selectively engaging a bow string of a crossbow when said device is placed in a cocking position on said crossbow.

14. The device according to claim 13, wherein said first and second handles each have an inner cavity, said first and second retractable Allen wrenches of said first handle being disposed within said inner cavity of said first handle when in a retracted position; said first and second retractable Allen wrenches of said second handle being disposed within said inner cavity of said second handle when in a retracted position.

15. The device according to claim 14, wherein said first and second retractable Allen wrenches of said first handle each has a curved proximal end and a straight distal end, said curved proximal end pivotally affixed to said first handle within said inner cavity.

16. The device according to claim 15, wherein said first and second retractable Allen wrenches of said second handle each has a curved proximal end and a straight distal end, said curved proximal end pivotally affixed to said second handle within said inner cavity.

17. A method of using a multi-purpose crossbow cocking device comprising the steps of:

a) providing a multi-purpose crossbow cocking device comprising: a draw cord having a first end and a second end; a first handle attached to said first end of said cord, said first handle including an Allen wrench operationally affixed to said first handle; a second handle attached to said second end of said cord; a pair of pulley members, each pulley member having a hook, a pulley groove, and an opening for slidably retaining said cord, said hook capable of selectively engaging a bow string of a crossbow when said device is placed in a cocking position on said crossbow; and b) manipulating said first handle in order to use said Allen wrench to drive a bolt or screw operatively associated with said crossbow, said bolt or screw having a hexagonal shaft head.

18. The method according to claim 17, further comprising the steps of:

c) placing a middle section of said cord in a cocking groove positioned on a stock of said crossbow;

d) attaching said hooks of said pair of pulley members to said bow string;

e) pulling said first and second handles in an upward direction towards a rearward end of said stock until said bow string is retained by a trigger mechanism of said crossbow; and f) removing said hooks of said pair of pulley means from said bow string.

* * * * *